United States Patent [19]

Rademakers

[11] Patent Number: 4,639,227

[45] Date of Patent: Jan. 27, 1987

[54] BUOY

[75] Inventor: Petrus J. Rademakers, Aerdenhout, Netherlands

[73] Assignee: Datawell B.V.

[21] Appl. No.: 338,628

[22] Filed: Jan. 11, 1982

[30] Foreign Application Priority Data

Jan. 15, 1981 [NL] Netherlands ..... 8100166

[51] Int. Cl.[4] ..... B63B 22/18

[52] U.S. Cl. ..... 441/1; 441/22; 441/23; 441/28; 343/709; 343/715

[58] Field of Search ..... 114/267, 182; 441/1, 441/6, 11, 20, 21, 22, 23, 28, 29, 32, 33; 343/709, 710, 715

[56] References Cited

U.S. PATENT DOCUMENTS

| | | | |
|---|---|---|---|
| 3,360,811 | 1/1968 | Bartlebaugh | 441/6 |
| 3,587,103 | 6/1971 | Lawrie | 343/709 |
| 3,674,225 | 7/1972 | Johnson | 441/33 |
| 3,708,982 | 1/1973 | Blockwick | 114/267 |
| 3,775,787 | 12/1973 | Rager | 441/23 |
| 3,800,601 | 4/1974 | Soulant, Jr. | 73/170 A |
| 3,916,467 | 11/1975 | Curd, Jr. | 441/28 |
| 4,231,131 | 11/1980 | Young | 114/182 |

FOREIGN PATENT DOCUMENTS 1272816 8/1961 France .

OTHER PUBLICATIONS

"A Discus-Hulled Wave Measuring Buoy", Robert H. Stewart, *Ocean Engineering*, vol. 4, No. 2, pp. 101-107, May 1977.

"Radar-Reflector Target Buoys Double for Enemy Submarines", Popular Science, Sep. 1953, p. 115.

*Primary Examiner*—Sherman D. Basinger
*Assistant Examiner*—Rod Corl
*Attorney, Agent, or Firm*—Larson & Taylor

[57] ABSTRACT

A buoy having a mainly circular upper surface and on this surface an auxiliary circular float body located at the center of this surface, the dimensions of the this upper surface and the auxiliary float body being such, that the buoy in rough water restores automatically its original position after it has been reversed and that wind forces create pressure deviations on this surface that compensate the tilting momentum exerted by the wind on the auxiliary float body itself and even the rest of the buoy.

7 Claims, 1 Drawing Figure

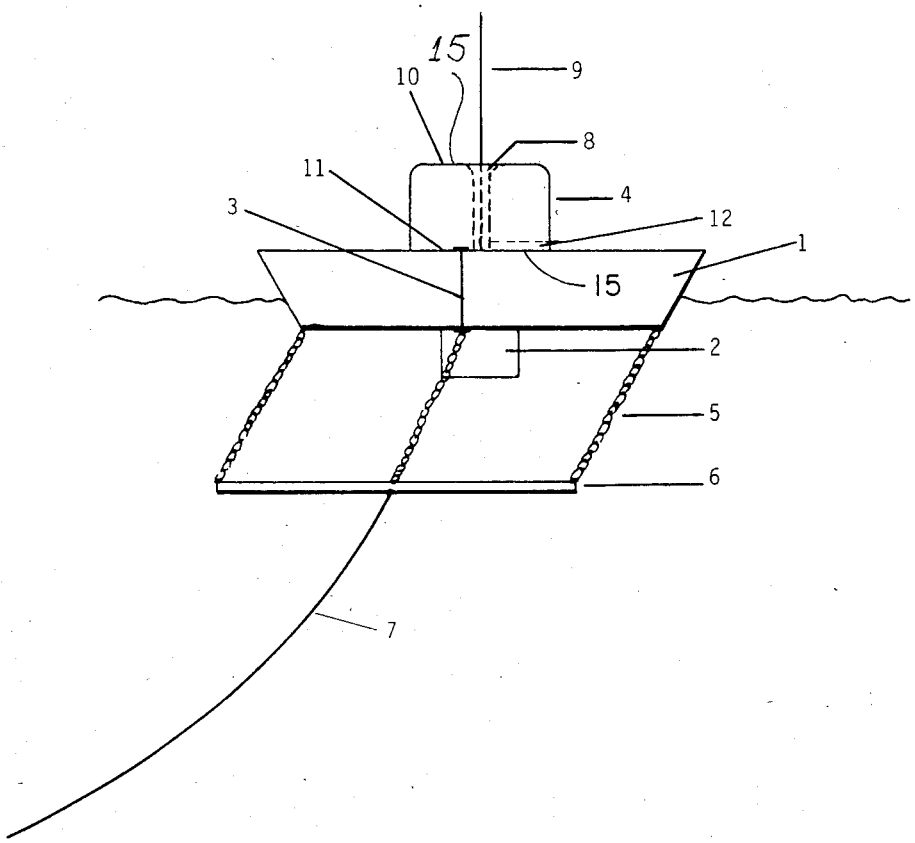
15
10
9
8
11
4
3
12
1
15
2
5
6
7

BUOY

The invention relates to a buoy having a mainly circular horizontal cross section and a shape and weight distribution for following the angular movement of the water surface, said buoy having a disc shaped mainly circular main float body with a horizontal upper surface. Such buoys may be used for measuring the deviations from the horizontal position of the water surface, mostly in two mutually perpendicular directions. An example of such a buoy has been shown in the U.S. Pat. No. 3,800,601 to Soulant.

A difficulty with buoys of the indicated type is, that they become inactive when they are reversed as may happen in rough weather or that the centre of gravity is positioned rather low for preventing reversion, but in that instance the buoy cannot very easily follow the water surface tilting movements.

The invention aims to prevent these difficulties.

Accordingly the invention provides that on the upper surface an auxiliary mainly circular float body is mounted, said auxiliary float body being concentric with the said cross section but having a smaller diameter, said auxiliary float body having further sufficient buoyancy for restoring the normal right-up position after upside down reversal by violent water and air movements.

Though reversing back into the original position may happen in quiet water when at each angle the buoy includes with the vertical a rotary momentum in the restoring direction is generated, it suffices in normal conditions in which the buoy may be reversed, that is to say when considerable waves are present, that the auxiliary float body has a buoyancy that is greater than the weight of the total buoy and its contents.

One of the important advantages of the invention is, that the tilting momentum exerted by the wind is compensated at least partly. The reason of this compensation is, that at the upstream side where the wind impacts the auxiliary float body a pressure increase occurs, that exerts a downward force on the said upper surface which force works opposite to the tilting momentum exerted by the same pressure increase on the auxiliary float body. The same holds at the down-stream side of the buoy, where a pressure decrease occurs causing tilting momentums exerted by the said upper surface and the wall of the auxiliary float body which work in opposite sense.

It is possible to make the momentum exerted by the pressure increase and decrease on the said upper surface greater than the momentum exerted by the wind on the auxiliary float body, so that it is even possible to make the influence of the wind on the buoy with auxiliary float body smaller than on a buoy without such a body.

According to a preferred embodiment of the invention it is provided that the auxiliary float body is mainly cylindrical with a diameter from 0.2 to 0.8 times the diameter of the disc shaped main float body. In this respect it is remarked, that within the indicated preferred region of diameter's proportions it is possible to find a height of the auxiliary float body giving the best compensation. A very small height will hardly give any result, whereas a great height will always give a greater momentum exerted by the auxiliary float body than the compensation momentum exerted on the said horizontal surface. Because both momentums in first instance are proportional to the square of the wind velocity and consequently a compensation effect obtained with a first wind velocity in principle occurs also with other wind velocities, it is fairly within the reach of the expert to determine theoretically or experimentally dimensions of the auxiliary float body that give the desired compensation.

It is remarked, that a known buoy called a waterway marker is described in the U.S. Pat. No. 3,360,811 to Bartlebauch, in which the disc shaped main float body is square, the height of the auxiliary float body is far too great to obtain a reasonable compensation and the buoy itself has such a weight distribution, that the buoy will not or only partially follow the tilting movements of the water surface.

A further advantage of the invention is, in case the buoy is provided with an antenna, that the possibility exists to provide the auxiliary float body with a central vertical pass way that is flared at its upper side, an antenna being located in said pass way and protruding from it. Herewith the relatively expensive resilient mounting of the antenna, which up till now with measuring buoys was necessary to prevent breaking off the antenna, is obviated. In fact a better protection of the antenna is obtained, not only when the buoy is in the water but also when bringing the buoy into the water or with collision and suchlike. The flaring allows in that instance that the antenna, which mostly is made of flexible material, can yield without being cracked on the edge.

Preferably it is provided that scupper pass ways are connected to the lower side of said central pass way.

For a number of reasons it is in many instances advantageous to provide a buoy of the type of the invention with a housing protruding below the main float body, for instance for housing instruments. The advantages of such a downwardly protruding house are described in my copending Patent Application "Buoy for measuring wave slopes".

This invention provides the possibility to save the instruments in case the buoy by a collision or other severe damage is partly destroyed, for instance because the main float body has gone astray. Accordingly a further elaboration of the invention provides in that the auxiliary float body forms a mechanical unit with a housing protruding from the lower side of the said disc shaped main float body, said unit being connected to an anchor line.

Herewith it is prevented that the instruments are lost, because the auxiliary float body bears the housing and the anchor line prevents drifting away.

A further advantage of the auxiliary float body is that it allows to provide the buoy with a radar reflector. Specially because measuring buoys may be located in regions where ships pass signaling the presence of the measuring buoy is important. A radar reflector is an important means for this purpose because it does not need energy as would for instance illumination of the buoy, whereas more and more ships are provided with radar. A known three-planes radar reflector having three mutually perpendicular plane reflector surfaces, which has the property to reflect an incoming beam in its own direction, is a well known embodiment hereof. This invention gives the possibility to mount such a reflector without increasing the wind sensibility in providing that the said auxiliary float body is provided with walls that are transmissive for radar waves and in which further inside said auxiliary float body plane radar reflectors are mounted in three mutually perpendicular planes.

The mutual orientation of the reflector surfaces has to be rather correct, so that they will need a rather heavy construction if they are not mechanically protected. Consequently mounting the reflector above the auxiliary float body would lift the center of gravity and induce a greater wind sensibility.

In the following, the invention is elucidated by the drawing in which the FIGURE schematically shows a side view of a buoy according to the present invention.

In the drawing reference 1 is a mainly disc shaped float body consisting of four circle segments applied around a cylindrical downwardly protruding housing 2. These segments can for instance be mounted by means of I-beams 3 which are fixedly connected to the wall of the housing 2.

Preferably by means of the I-beams 3 an auxiliary float body 4 is fixedly connected to the housing 2, which body 4 is coaxial to body 1 and has such a volume, that, when the buoy is reversed it lifts the total buoy just above the water. To the I-beams 3 connection chains 5 are connected which themselves are connected to an anchoring member 6 that in this instance has the shape of a cross to the centre of which an anchor line 7 has been connected.

Central in the auxiliary float body 4 a pass way 8 has been made through which an antenna 9 protrudes. In the auxiliary float body 4 mutually perpendicular radar reflector surfaces have been mounted, whereas the upper surface 10 and/or the lower surface 11 consist of a material 15 reflecting electro-magnetic waves or are covered with such a material.

Because the antenna 9 protrudes through the pass way 8 which at its upper side is flared, it is supported at a location at a distance from its mounting point when it is bent, so that no local high stress will occur as would be the case if a sharp edge would be present and practice has shown that herewith the normal but expensive and relatively vulnerable resilient mounting of the antenna is superfluous, which also could cause impedance matching problems.

When a buoy according the invention is reversed the buoyancy of the auxiliary float body 4 sees to it that it is reversed back again. If by collision or suchlike severe damage occurs wherewith segments of the float body 1 can be lost, the rest of the buoy still floats by reason of the buoyancy of float body 4 and remains connected to the anchor line 7, because the housing 2, the I-beams 3 and the auxiliary float body 4 form a mechanically strong unit.

Because the pass way 8 can receive water, as well the water in which the buoy floats with heavy weather as rain, a scupper pass way 12 has been applied. The bottom of the auxiliary float body 4 and the housing 2 form a mechanical strong unit, for instance of steel.

The reflector surfaces in the float body 4 have a gap adjacent the pass way 8, it is true, but with a normal execution a sufficient surface remains for a well detectable radar reflection.

What I claim is:

1. Buoy having a mainly circular horizontal cross-section with a diameter which is greater than the height of the buoy and a shape and weight distribution for following the angular movement of the water surface and for measuring wave slopes, said buoy having a disc shaped mainly circular main float body with a generally flat lower surface in contact with the water and with a horizontal upper surface, in which on the said upper surface an auxiliary mainly circular float body is mounted, said auxiliary float body being concentric with the said cross-section but having a smaller diameter, said auxiliary float body having further sufficient buoyancy for restoring the normal right-up position after upside down reverse by violent water and air movements, said auxiliary float body still further having a shape, horizontal dimension and height such that the tilting moment exerted by wind forces on sid auxiliary float body is compensated by the pressure distribution caused by said auxiliary float body on the said upper surface.

2. Buoy according to claim 1, in which the buoyancy of the auxiliary float body is greater than the weight of the total buoy and its contents.

3. Buoy according to claim 1, in which the auxiliary float body is mainly cylindrical with a diameter from 0.2 to 0.8 times the diameter of the disc shaped main float body.

4. Buoy according to claim 1, in which the auxiliary float body is provided with a central vertical pass way that is rounded outwardly at its upper side, an elastic antenna being located in said pass way in spaced relation thereto and protruding therefrom.

5. Buoy according claim 4, in which scupper pass ways are connected to the lower side of said central pass way.

6. Buoy according to claim 1, in which the auxiliary float body forms a complete mechanical unit with a housing protruding from the lower side of the said disc shaped main float body, said main float body being attached to said unit and said unit being connected to an anchor line.

7. Buoy according to claim 1, in which the said auxiliary float body is provided with walls that are transmissive for radar waves and in which further inside said auxiliary float body plane radar reflectors are mounted in three mutually perpendicular planes.

* * * * *